United States Patent [19]

Su

[11] Patent Number: 4,494,880

[45] Date of Patent: Jan. 22, 1985

[54] FOLDABLE CLOCK DIAL

[76] Inventor: Wen-Kuang Su, 11th Fl. No. 56 Nan-King E. Rd. Sec. 4, Taipei, Taiwan

[21] Appl. No.: 590,022

[22] Filed: Mar. 14, 1984

[51] Int. Cl.[3] ..... G04B 19/06

[52] U.S. Cl. ..... 368/232

[58] Field of Search ..... 368/223, 228, 232–235, 368/314

[56] References Cited

FOREIGN PATENT DOCUMENTS 807897 3/1969 Canada ..... 368/232

*Primary Examiner*—Vit W. Miska

*Attorney, Agent, or Firm*—Holman & Stern

[57] ABSTRACT

A foldable clock dial comprises a plurality of foldable plates, the volume of which can be diminished when being folded up so as to facilitate packaging, and which can form a complete clock dial when being restored. The plates can be made by sheets of metal, cardboard, plastic or other materials. A clock including such a foldable dial can be used as an ideal item of free gift for sales promotion or as a seasonal ornament.

6 Claims, 8 Drawing Figures

FOLDABLE CLOCK DIAL

DETAILED DESCRIPTION OF THE INVENTION

This invention relates to a foldable clock dial and in particular to a clock dial comprising a plurality of plates which are freely foldable and extendable.

Conventional clocks have larger dials forming part of the clock cases which provide adequate room to house the parts and components and give a clearer vision. As a result of the development of electronic techniques, quartz, integrated circuits and the like have been widely used to form the clock movement mechanism during recent years. Such electronic clock movement mechanism does not require a large case to house the parts and components, but, for retaining the provision of a clearer vision, it is still undesirable to diminish the size of the dial when a clock is hung on the wall. As such, a large clock case does not serve the actual need, but rather occupies a large space and causes a redundant increase in weight and size when being packaged. Although there are clock designs omitting clock cases, the dials thereof still take up a large space. Therefore, especially when being packaged for export, there is a disadvantage that the cost of freight will be increased owing to the large dial.

The primary object of this invention is to provide a foldable clock dial comprising a plurality of plates, capable of being folded up into a small size of the plate and extended to form a large complete dial, the use of which does not hinder the indication and reading of time, but will diminish the volume of the article when being packed up and thus eliminate the drawbacks as mentioned above.

Further objects of the invention together with additional features contributing thereto and advantages accruing therefrom will be apparent from the following description of preferred embodiments of the invention with reference to the accompanying drawings wherein.

Figure 1:
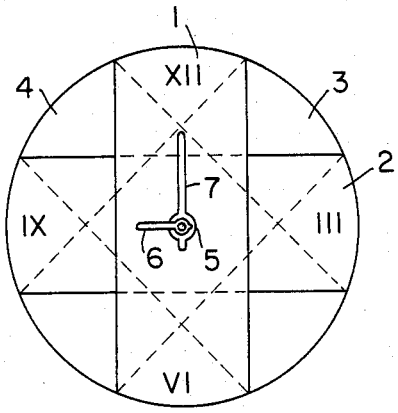
FIG. 1 is a front view of the first embodiment of the foldable clock dial in its extended position according to this invention.
Figure 3:
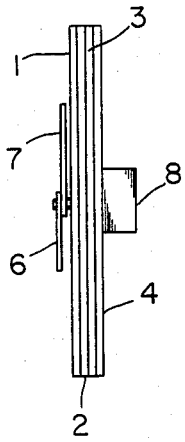
FIG. 3 is a side view of the clock shown in FIG. 2.

Referring to FIG. 1, there is shown a first embodiment of the foldable clock dial according to this invention. As shown in FIG. 1, the clock dial comprises four plates 1, 2, 3, and 4 of identical size and shape. Each plate is defined by two parallel straight sides and two arcuate sides. Each of the arcuate sides is an arc equal to one eighth of the periphery of a round clock dial to be formed. And, each of the plates has a hole at its center for being snugly and rotatably mounted onto a sleeve around the axle to which the clock hands are attached. These four plates 1, 2, 3 and 4 are assembled onto the axle sleeve in superimposed position with the axle sleeve passing through their registered central holes as best seen in FIG. 3, and each plate being snugly fitted but rotatable about the axle sleeve. These plates can be made of metal, cardboard, plastic and the like, but the material used should preferably be durable with siutable thickness.

Two clock hands 6, 7 are attatched to an axle of the clock movement housed in a box 8 so that the hands 6, 7 are adapted to move in front of the dial as in conventional manner. As well known, the clock movement box 8 can be made to a small size, and as shown in FIG. 3, the clock movement box 8 is located right behind the clock dial plate 4. The size of the clock movement box 8 can be even smaller than the size of a single plate. The figures for time reading can be printed or attached on plates 1, 2 as shown.

Figure 2:
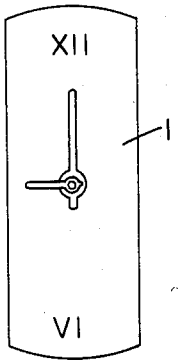
FIG. 2 is a front view of the clock dial of FIG. 1 in its folded position.

In folding up this dial, plates 2, 3 and 4 are rotated into stack with plate 1, piling up in sequence one against another, forming the size of a single plate as shown in FIGS. 2 and 3. By comparing FIG. 1 with FIG. 3, it is apparent that the size of the dial in folded-up position is only about one third of that of the full dial. The difference is so big that advantageously saves the cost of freight and storage when the clocks are packaged for export.

The lengthwise ends of the plates 1–4 shown in FIG. 1 are of arc shape as described above, so that a complete round dial can be formed when the plates are extended to restore the dial. However, the lengthwise ends of the plates 1–4 can also be parallel straight shapes, so as to form an octagonal dial when the plates are extended to restore the dial.

Figure 4:
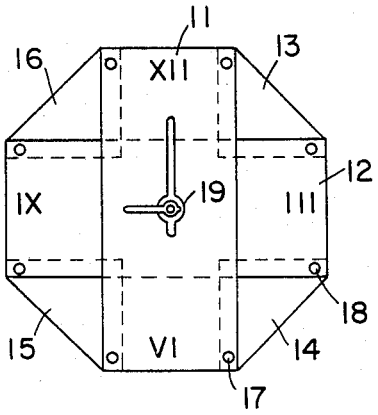
FIG. 4 is a front view of the second embodiment of the foldable clock dial in its extended position according to this invention.

Referring to FIG. 4, there is illustrated a second embodiment of the clock dial according to this invention. As shown in FIG. 4, in this embodiment, the dial comprises two rectangular plates 11, 12 and four triangular supplemental plates 13, 14, 15, 16. These two rectangular plates 11, 12 have holes at their center for being mounted onto the axle sleeve of the clock movement in a manner similar to the finst embodiment described above. The four triangular supplemental plates 13, 14, 15, 16 are adapted to be affixed to the corners of the two rectangular plates by means of suitable fastening means 17, 18 such as pinch dogs, studs and the like in order to form an octagonal dial. The fastening means 17 and 18 may be both detachable or one detachable while another fixed. As an example, fastening means 17 is fixed and fastening means 18 is detachable. If fastening means 18 is detachable, then after the fastening means 18 is released, the triangular supplemental plate 14 can be rotated about an axis passing through the fastening means 17 and perpendicular to the clock dial, so as to be positioned behind the lower end of the rectangular plate 11. By the same operation, supplemental plate 15 may be positioned at the underside of the plate 12 at left end; supplemental plate 16 may be positioned at the underside of the plate 11 at the upper end; supplemental plate 13 may be positioned at the underside of the plate 12 at right end; and finally using the axle sleeve 19 as a pivot point to rotate the plates 11, 12 into a stack. This operation results in a folded dial in the state as shown in FIG. 2.

Figure 5:
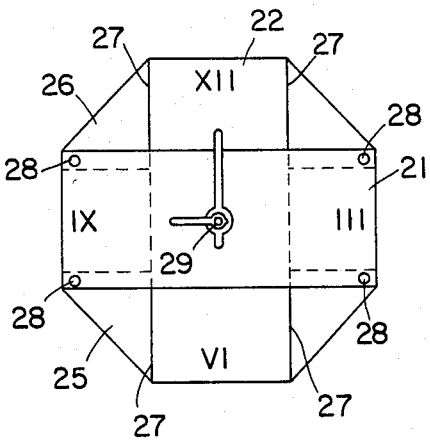
FIG. 5 is a front view of the third embodiment of the foldable clock dial in its extended position according to this invention.

Referring to FIG. 5, there is shown a third embodiment of the clock dial according to this invention. In this embodiment, the dial is of octagonal shape also, but the dial comprises two pieces of plates, that is, plates 21 and 22. The plate 21 is of rectangular shape and similar to plate 12 described with reference to FIG. 4 in the above-mentioned embodiment. But, the plate 22 includes a rectangular body portion similar to the plate 11 in the above embodiment and four triangular wing portions 23, 24, 25, 26 integral with the body portion as shown in FIG. 5. The wing portions 23, 24, 25, 26 are connected to the body portion at lines 27, and all wing portions are foldable at lines 27. At the tip of each wing portion, there is provided a detachable fastening means 28 such as studs or pinch dogs for fixing the tip of the wing portion onto the rectangular plates 21 in order to form an octagonal dial. To fold up the dial, all fastening means 28 are released and then the wing portions 23–26 are folded along the folding lines 27 into the underside of the body portion of the plate 22. and thus, using the axle sleeve 29 as a pivot point to rotate the plates 21 and 22 into stack with the wing portions 23–26 folded at the underside. This operation results in a folded-up dial in the state as shown in FIG. 2.

Figure 6:
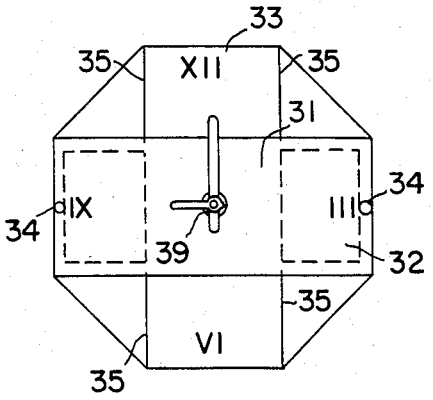
FIG. 6 is a front view of the fourth embodiment of the clock dial in its extended position according to this invention.

Referring to FIG. 6, a fourth embodiment of the foldable clock dial according to this invention is shown. In this embodiment, the dial is of octagonal shape also, and the dial comprises two pieces of plates 31, 33 in which, plate 31 is similar to plate 21 described in the third embodiment and plate 33 is similar to plate 22 described in the third embodiment shown in FIG. 5, with the exception that, either two wing portions on the same side are connected by a bridging portion and thus defining an opening 32 on either side of the body portion, and the bridging portions are attached to the plate 31 by fastening means 34 as shown in FIG. 6. In this embodiment, the wing portions are adapted to be folded along lines 35. The folded-up operation of this embodiment is similar to that of the third embodiment.

Figure 7:
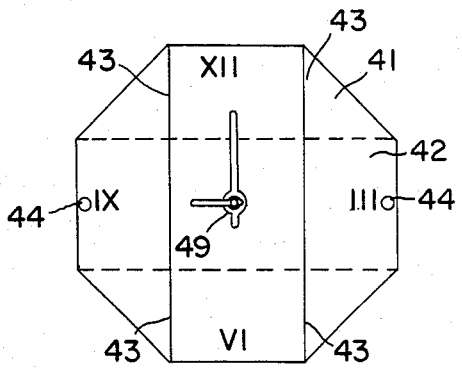
FIG. 7 is a front view of the fifth embodiment of the foldable clock dial in its extended position according to this invention.
Figure 8:
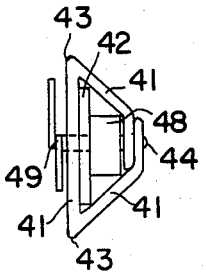
FIG. 8 is a side view of the fifth embodiment when in folded-up position.

Referring to FIGS. 7 and 8, a fifth embodiment of the foldable clock dial according to this invention is shown. In this embodiment, the dial is of octagonal shape also, and the dial comprises two pieces of plates 41, 42. The plate 41 is octagonal and has two parallel folding lines 43 as shown. The plate 42 is similar to plate 12 described in the second embodiment. Fastening means 44 are provided for fixing the plate 41 onto the plate 42 thereunder. In folding the dial, the fastening means 44 are released and the plate 42 is rotated about the axle sleeve into a position with its lengthwise direction parallel to the folding lines 43. Thereafter, the plate 41 is folded along the folding lines 43 to enclose the plate 42 and the clock movement box 48, and then the fastening means 44 are used to fix the overlapping portion of the folded plate 41, as shown in FIG. 8. Thus, this clock dial can be folded up into a compact package as shown in FIG. 8. The folded-up dial has a font view similar to that as shown in FIG. 2.

The construction of this invention is simple. It is convenient to use and the cost of manufactuse is low. Therefore, a clock including the foldable dial according to this invention can be used as an ideal item of free gift for sales promotion or as a seasonal ornament.

What is claimed is:

1. A foldable clock dial comprising a plurality of plates adapted to be coaxially mounted on the axle sleeve of a clock movement in such a manner that the plates can be rotated about the axle sleeve into a first position to form a complete dial having a predetermined shape, and into a second position in which the plates are folded up to form a small, compact package.

2. A foldable clock dial as claimed in claim 1, wherein the plates have their shapes adapted to form a round dial when in the first position.

3. A foldable clock dial as claimed in claim 1, wherein the plates have their shapes adapted to form an octagonal dial when in the first position.

4. A foldable clock dial as claimed in claim 3, wherein the plates includes two identical rectangular plates, and further includes four triangular supplemental plates which are adapted to be connected to the rectangular plates by detachable fastening means to form the octagonal shape of the dial.

5. A foldable clock dial as claimed in claim 4, wherein the four triangular supplemental plates are formed integral with one of the rectangular plates and are adapted to be folded along folding lines which are in the lengthwise side lines of the rectangular plate.

6. A foldable clock dial as claimed in claim 3, wherein the plates includes one octagonal plate and a rectangular plates, the octagonal plate having a pair of folding lines so as to be folded into a shape identical to the rectangular plate, and detachable, fastening means for fixing the octagonal plate to the rectangular plates when in the first position.

* * * * *